US011852054B2

(12) United States Patent
McCloy et al.

(10) Patent No.: US 11,852,054 B2
(45) Date of Patent: Dec. 26, 2023

(54) VARIABLE CAMSHAFT TIMING SYSTEM

(71) Applicant: BorgWarner Inc., Auburn Hills, MI (US)

(72) Inventors: Chad M. McCloy, Cortland, NY (US); David C. White, Dryden, NY (US); Shawn Blackmur, Brooktondale, NY (US); Timothy W. Kunz, Rochester, NY (US); Brian T. Kenyon, McGraw, NY (US)

(73) Assignee: BORGWARNER INC., Auburn Hills, MI (US)

( * ) Notice: Subject to any disclaimer, the term of this patent is extended or adjusted under 35 U.S.C. 154(b) by 0 days.

(21) Appl. No.: 17/477,756

(22) Filed: Sep. 17, 2021

(65) Prior Publication Data

US 2023/0090525 A1 Mar. 23, 2023

(51) Int. Cl.

| | |
|---|---|
| ***F01L 1/356*** | (2006.01) |
| ***F01L 1/047*** | (2006.01) |
| *F01L 1/344* | (2006.01) |

(52) U.S. Cl.

CPC ..... *F01L 1/356* (2013.01); *F01L 1/047* (2013.01); *F01L 2001/0473* (2013.01); *F01L 2001/34483* (2013.01); *F01L 2001/34489* (2013.01)

(58) Field of Classification Search

None

See application file for complete search history.

(56) References Cited

U.S. PATENT DOCUMENTS

| | | | | |
|---|---|---|---|---|
| 2,079,009 | A * | 5/1937 | Gregg | F01L 1/344 464/3 |
| 3,516,394 | A * | 6/1970 | Nichols | F01L 1/34413 74/567 |
| 5,161,493 | A * | 11/1992 | Ma | F16D 3/10 123/90.31 |
| 5,417,186 | A | 5/1995 | Elrod et al. | |
| 6,044,816 | A | 4/2000 | Buck et al. | |
| 6,253,719 | B1 | 7/2001 | Methley | |
| 7,536,986 | B2 | 5/2009 | Schneider | |

(Continued)

FOREIGN PATENT DOCUMENTS

| | | | | |
|---|---|---|---|---|
| DE | 102013019819 | A1 * | 5/2015 | F01L 1/344 |
| EP | 3141711 | A1 * | 3/2017 | |

(Continued)

OTHER PUBLICATIONS

WO-2015150175 English Language Machine Translation (Year: 2015).*

*Primary Examiner* — Wesley G Harris

(74) *Attorney, Agent, or Firm* — REISING ETHING P.C.

(57) ABSTRACT

A variable camshaft timing (VCT) system includes an independent camshaft phaser, receiving input from a crankshaft of an internal combustion engine, having an output coupled to one of an inner concentric camshaft or an outer concentric camshaft; and a dependent camshaft phaser, coupled to the other of the inner concentric camshaft or the outer concentric camshaft, comprising a half-Oldham link configured to permit radial movement of the inner concentric camshaft relative to the outer concentric camshaft in one radial direction and at least one pivotable arm configured to permit radial movement of the inner concentric camshaft relative to the outer concentric camshaft in another, different radial direction.

11 Claims, 4 Drawing Sheets

(56) References Cited

U.S. PATENT DOCUMENTS

| | | | |
|---|---|---|---|
| 7,866,293 | B2 | 1/2011 | Clever et al. |
| 7,938,090 | B2 | 5/2011 | Lancefield et al. |
| 8,113,159 | B2 | 2/2012 | Myers et al. |
| 8,122,863 | B2 | 2/2012 | Myers |
| 8,146,551 | B2 | 4/2012 | Pluta |
| 8,191,521 | B2 | 6/2012 | Kandolf et al. |
| 8,256,393 | B2 | 9/2012 | Simpson et al. |
| 8,261,705 | B2 | 9/2012 | Lancefield et al. |
| 8,336,512 | B2 | 12/2012 | Myers et al. |
| 8,375,906 | B2 | 2/2013 | Myers et al. |
| 8,522,737 | B2 | 9/2013 | Yokoyama et al. |
| 8,596,236 | B2 | 12/2013 | Chung et al. |
| 8,677,960 | B2 | 3/2014 | Knecht et al. |
| 8,695,545 | B2 | 4/2014 | Tateno |
| 8,978,605 | B2 | 3/2015 | Friedrichs |
| 9,297,281 | B2 | 3/2016 | Sisson et al. |
| 9,297,283 | B2 | 3/2016 | Schafer et al. |
| 9,366,159 | B2 | 6/2016 | Wigsten et al. |
| 9,506,379 | B2 | 11/2016 | Dupuis |
| 9,512,747 | B2 | 12/2016 | Kim |
| 9,638,306 | B2 | 5/2017 | Schafer et al. |
| 9,797,277 | B2 | 10/2017 | Chung et al. |
| 9,840,942 | B2 | 12/2017 | Zwahr et al. |
| 2005/0051121 | A1 | 3/2005 | Smith |
| 2005/0056249 | A1 | 3/2005 | Heinze et al. |
| 2008/0196681 | A1 | 8/2008 | Lancefield et al. |
| 2013/0092114 | A1 | 4/2013 | Pietsch et al. |
| 2014/0190434 | A1 | 7/2014 | Bayrakdar |
| 2015/0068474 | A1 | 3/2015 | Kim et al. |
| 2017/0254232 | A1 | 9/2017 | Stays |
| 2018/0010487 | A1* | 1/2018 | Tanaka ..... F01L 1/053 |
| 2020/0165943 | A1* | 5/2020 | Keefover ..... F01L 1/047 |
| 2020/0200052 | A1* | 6/2020 | Blackmur ..... F01L 1/352 |

FOREIGN PATENT DOCUMENTS

| | | | | |
|---|---|---|---|---|
| EP | 3141711 | A1 | 3/2017 | |
| GB | 2401163 | A | 11/2004 | |
| GB | 2424258 | A * | 9/2006 | ..... F01L 1/022 |
| WO | WO-2015150175 | A1 * | 10/2015 | ..... F01L 1/047 |

* cited by examiner

VARIABLE CAMSHAFT TIMING SYSTEM

TECHNICAL FIELD

The present application relates to variable camshaft timing and, more particularly, to a variable camshaft timing device used with concentric camshafts.

BACKGROUND

Internal combustion engines (ICEs) use one or more camshafts to open and close intake and exhaust valves in response to cam lobes selectively actuating valve stems as the camshaft(s) rotate overcoming the force of valve springs that keep the valves seated and displacing the valves. The shape and angular position of the cam lobes can affect the operation of the ICE. In the past, the angular position of the camshaft relative to the angular position of the crankshaft was fixed. But it is possible to vary the angular position of the camshaft relative to the crankshaft using variable camshaft timing (VCT). VCT can be implemented using VCT devices (sometimes referred to as camshaft phasers) that change the angular position of the camshaft relative to the crankshaft. These camshaft phasers can be hydraulically- or electrically-actuated and are typically directly attached to one end of the camshaft.

VCT devices can be used with a variety of differently-configured ICEs. For example, an ICE can use concentric camshafts that can be angularly displaced relative to each other. However, some amount of tolerance or space may exist between an inner camshaft and an outer camshaft. As VCT devices couple to the inner camshaft and the outer camshaft, the inner camshaft may move relative to the outer camshaft in a way that causes the camshafts to bind such that the camshafts are not easily angularly displaced relative to each other. It would be helpful to provide a VCT system that prevents concentric camshafts from binding.

SUMMARY

In one implementation, a variable camshaft timing (VCT) system includes an independent camshaft phaser, receiving input from a crankshaft of an internal combustion engine, having an output coupled to one of an inner concentric camshaft or an outer concentric camshaft; and a dependent camshaft phaser, coupled to the other of the inner concentric camshaft or the outer concentric camshaft, comprising a half-Oldham link configured to permit radial movement of the inner concentric camshaft relative to the outer concentric camshaft in one radial direction and at least one pivotable arm configured to permit radial movement of the inner concentric camshaft relative to the outer concentric camshaft in another, different radial direction.

In another implementation, a VCT system includes an independent camshaft phaser, receiving input from a crankshaft of an internal combustion engine, having an output coupled to one of an inner concentric camshaft or an outer concentric camshaft; and a dependent camshaft phaser comprising: a camshaft plate coupled to the output; one or more pivotable arms that engage the camshaft plate through one or more pins; one or more secondary pivotable arms that pivotably connect to the pivotable arms; and a half-Oldham plate pivotably coupled to the secondary pivotable arms; the half-Oldham plate permits radial movement of the inner concentric camshaft relative to the outer concentric camshaft in one radial direction, the pivotable arm(s) and the secondary pivotable arm(s) permit radial movement of the inner concentric camshaft relative to the outer concentric camshaft in another, different radial direction.

In yet another implementation, a VCT system includes an independent camshaft phaser, receiving input from a crankshaft of an internal combustion engine, having an output coupled to an outer concentric camshaft; and a dependent camshaft phaser comprising: a camshaft plate coupled to the outer concentric camshaft; one or more pivotable arms that engage the camshaft plate through one or more pins; one or more secondary pivotable arms that pivotably connect to the pivotable arms; a half-Oldham plate, pivotably coupled to the secondary pivotable arms, having a key slot; and a key, rigidly coupled to an inner concentric camshaft, that is received by the key slot; the key moves relative to the key slot to permit radial movement of the inner concentric camshaft relative to the outer concentric camshaft in one radial direction, the pivotable arm(s) and the secondary pivotable arm(s) permit radial movement of the inner concentric camshaft relative to the outer concentric camshaft in another, different radial direction.

DETAILED DESCRIPTION

Figure 1:
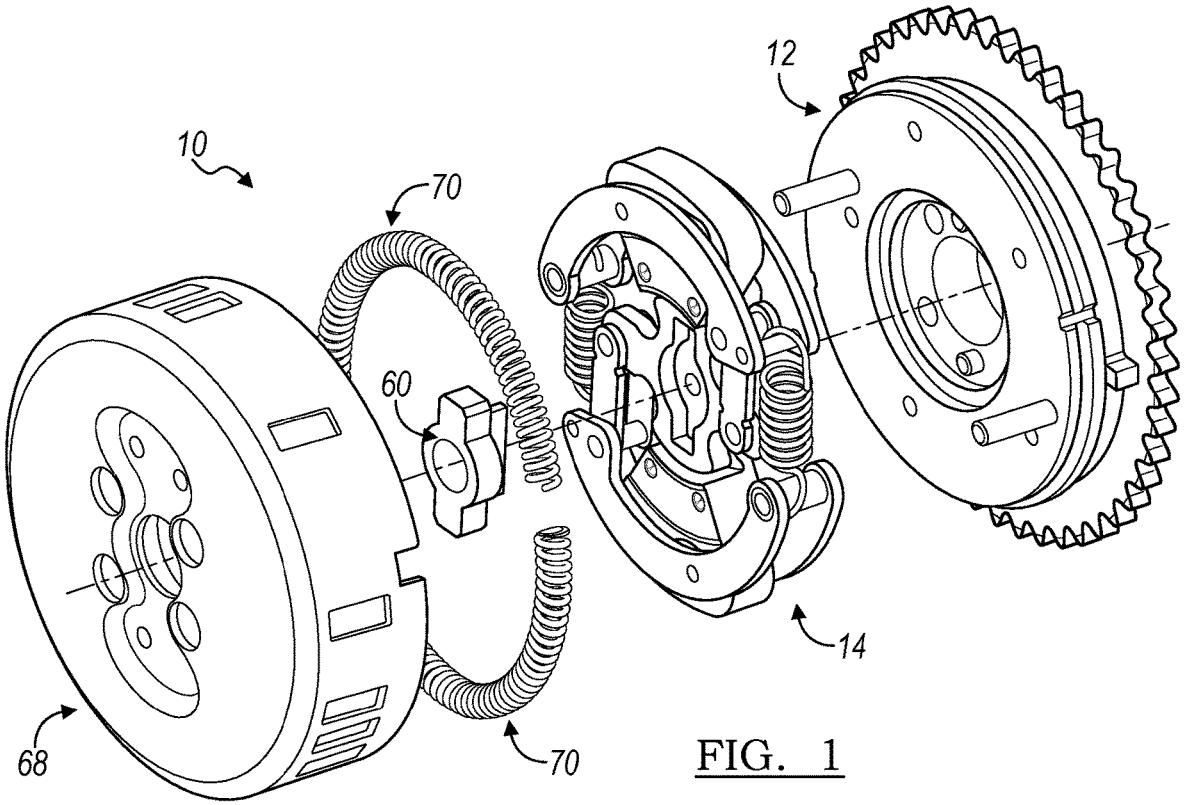
FIG. 1 is an exploded view depicting a portion of an implementation of a variable camshaft timing (VCT) system.
Figure 2:
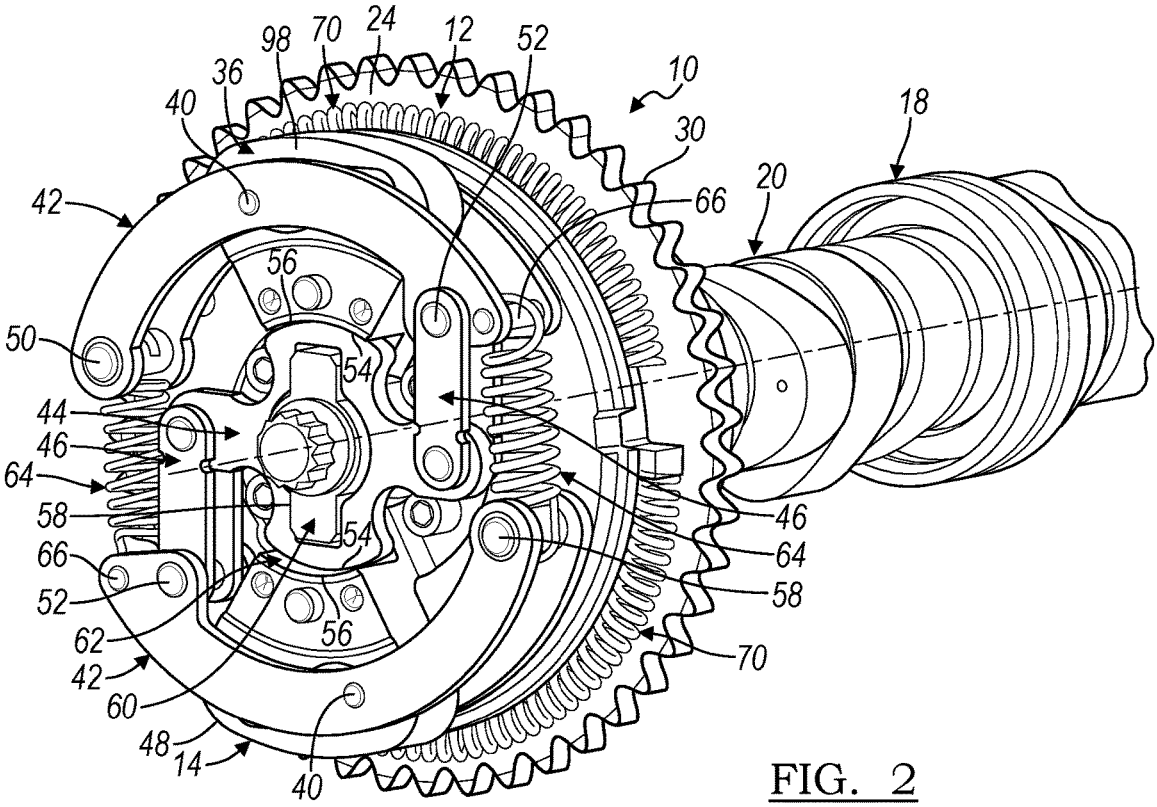
FIG. 2 is a perspective view depicting an implementation of a VCT system.
Figure 3:
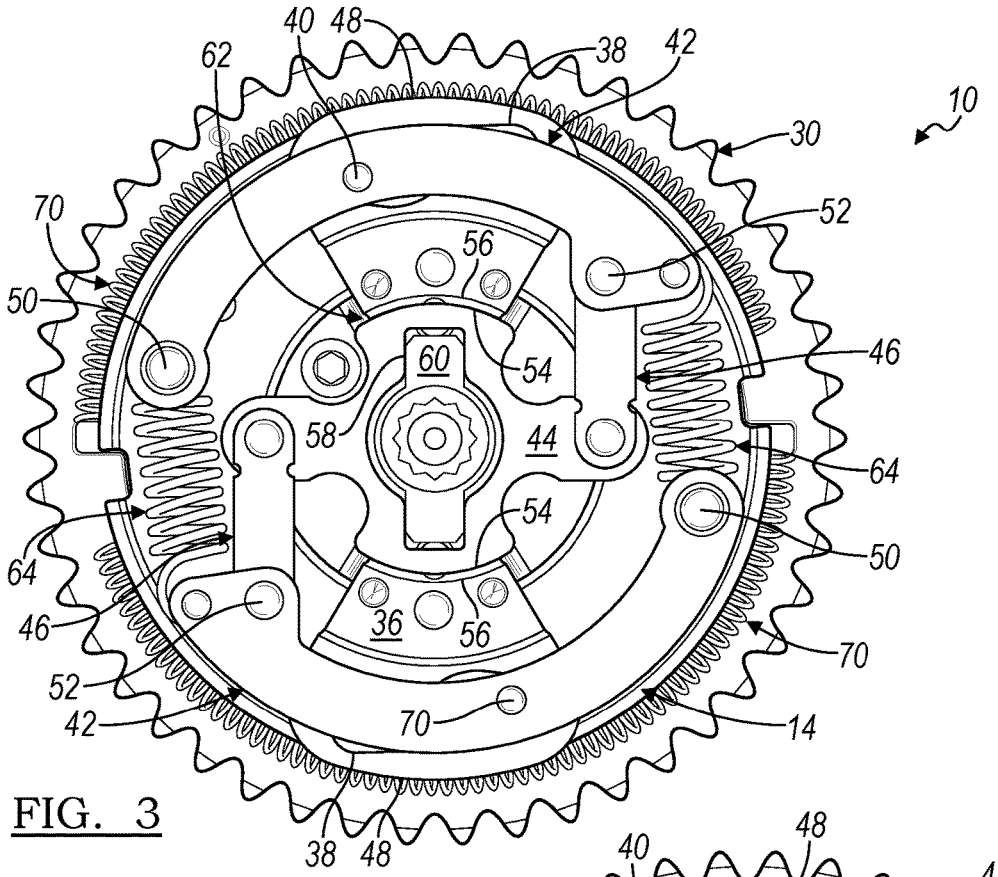
FIG. 3 is a profile view depicting an implementation of a VCT system.
Figure 4:
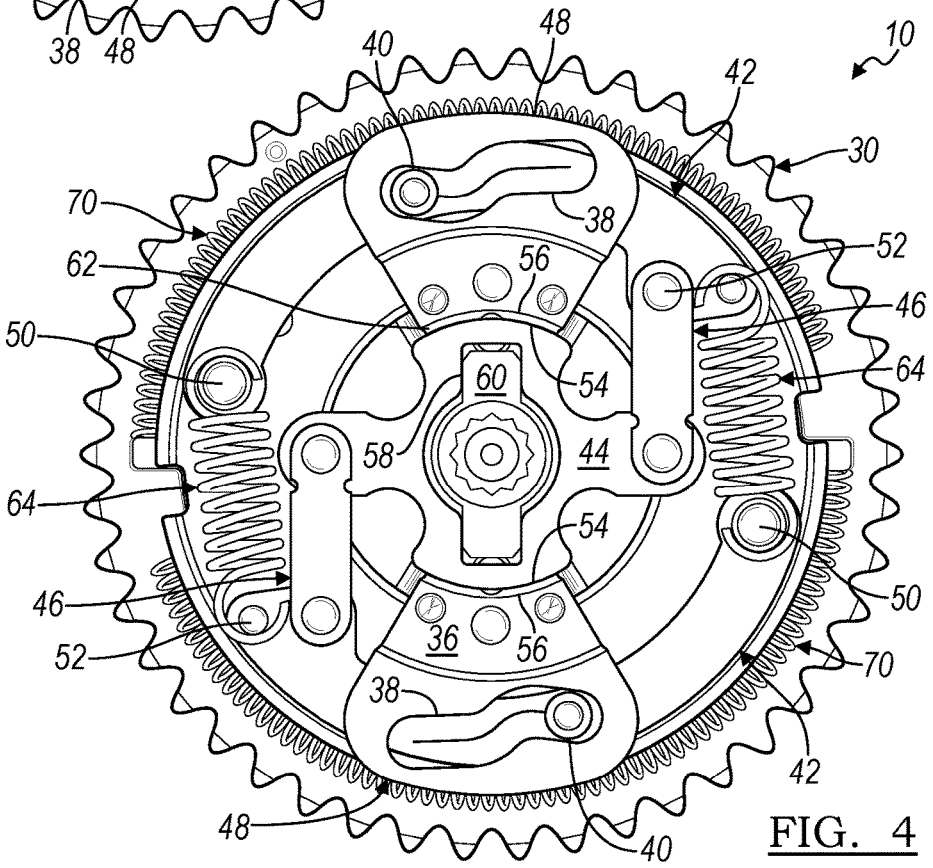
FIG. 4 is a profile view depicting a portion of an implementation of a VCT system.

A variable camshaft timing (VCT) system comprises an independent VCT device or independent camshaft phaser and a dependent VCT device or dependent camshaft phaser that collectively control the angular position of a first camshaft and a second camshaft. The first and second camshafts can be concentrically positioned relative to each other. The independent VCT device receives rotational input from a crankshaft through an endless loop or geared timing drive. The first camshaft is coupled to an output of the independent camshaft phaser that changes the angular position of the first camshaft relative to the crankshaft. Independent camshaft phasers can be implemented using electrically-actuated or hydraulically-actuated camshaft phasers. One implementation of an electrically-actuated camshaft phaser is described in U.S. Patent Application Publication No. 2017/0248045 the entirety of which is incorporated by reference.

A dependent camshaft phaser can link the output of the independent camshaft phaser to a second camshaft and change the angular position of the second camshaft relative to the first camshaft. The dependent camshaft phaser can comprise an assembly having a camshaft plate that is rigidly coupled with the output of the independent camshaft phaser and has a shaped slot or pins that are positioned radially outwardly from an axis of camshaft rotation. Pivotable arms having the other of the shaped slot or pins can engage the camshaft plate through the shaped slot/pins connection and communicate angular movement from the camshaft plate to the second camshaft. The pivotable arms can pivotably attach to a half-Oldham link via secondary pivotable arms. The half-Oldham link can include a key slot shaped to receive a key that couples with the second camshaft. The key and key slot relationship permits radial movement of the first camshaft relative to the second camshaft in one radial direction to accomplish one half of an Oldham coupling. A second half of the Oldham coupling can be implemented by the pivotable arms, the secondary pivotable arms, and/or the camshaft plate that can permit radial movement of the first camshaft relative to the second camshaft in a second radial direction. As the output of the independent VCT camshaft phaser angularly displaces the first camshaft with respect to the crankshaft, the angular motion of the output also can simultaneously change the angular position of the second camshaft with respect to the first camshaft via motion of the pins relative to the shaped slots thereby translating the angular movement of the camshaft plate through the pivotable arms, the secondary pivotable arms, the half-Oldham link, to the key and ultimately the second camshaft phaser.

The angular position of the second camshaft relative to the first camshaft can be controlled by selecting motion variables attributed to the dependent camshaft phaser. The motion variables include the distance of the shaped slot in the camshaft plate from the axis of camshaft rotation, the contour of the shaped slot, the length of the pivotable arms/secondary pivotable arms, and the distance between pivots and the axis of camshaft rotation, to name a few. The amount of relative angular movement between the first and second camshafts, along with the rate at which the relative movement occurs, can be defined by the selection of these motion variables.

Internal combustion engines (ICEs) use reciprocating pistons linked to a crankshaft. The pistons move within cylinders in response to controlled combustion of air and fuel in the presence of spark in combustion chambers. The control of the combustion is at least partially regulated by opening and closing intake and exhaust valves using rotating camshafts. The camshafts rotate relative to the crankshaft and during rotation the camshafts open and close intake and exhaust valves at specified times relative to the delivery of spark to the combustion chambers of the cylinders. ICEs can implement multiple camshafts in different ways. For example, some ICEs use multiple camshafts, dedicating one camshaft for controlling the operation of intake valves and another camshaft for controlling the operation of exhaust valves. And in some implementations, the intake valve camshaft and the exhaust valve camshaft are concentrically positioned relative to each other. In other implementations, concentric camshafts may be used to actuate a portion of the intake (or exhaust) valves relative to the remainder of the intake (or exhaust) valves. Concentrically positioned camshafts include a first concentric camshaft and a second concentric camshaft that can change angular position relative to each other. Concentric camshafts are known by those skilled in the art, an example of which is shown in FIG. 1 of U.S. Pat. No. 8,186,319 and described in column 6, lines 10-53; the contents of that portion of U.S. Pat. No. 8,186,319 are incorporated by reference. The VCT system can use a single sensor wheel to determine the angular position of both camshafts. Given the precise and predictable mechanical relationship between the rotational movement of the dependent camshaft phaser relative to the rotational motion imparted on it by the output of the independent camshaft phaser, the angular position of both camshafts can be resolved using one signal received from a single camshaft sensor wheel.

Turning to FIGS. 1-7, an implementation of a VCT system 10 is shown. The VCT system includes an independent camshaft phaser 12 and a dependent camshaft phaser 14. The independent camshaft phaser 12 has an output 16 that is coupled with an end of an outer concentric camshaft 18 and the dependent camshaft phaser 14 mechanically links the output 16 of the independent camshaft phaser 12 with an inner concentric camshaft 20. When the output 16 of the independent camshaft phaser 12 moves the outer concentric camshaft 18 relative to the crankshaft so that the angular position of the outer concentric camshaft 18 changes relative to the angular position of the crankshaft, the motion of the output 16 also changes the angular position of the inner concentric camshaft 20 relative to the outer concentric camshaft 18. It should be understood that the example of inner concentric camshaft and outer concentric camshaft is provided by way of example. However, other implementations using the independent camshaft phaser and the dependent camshaft phaser are possible. For example, one or both of the inner and outer concentric camshafts could be replaced instead by non-concentric camshafts and an intermediate gear or sprocket may be used to actuate a camshaft not on the same axis as the VCT system.

The independent camshaft phaser 12 in this implementation is a hydraulically-actuated camshaft phaser having a rotor 22 and a housing 24 (also referred to as a stator). The rotor 22 includes a generally annular hub 26 and one or more vanes 28 extending radially outwardly from the hub 26. In this implementation, the rotor 22 includes vanes 28 and serves as the output 16 of the independent camshaft phaser 12. The rotor 22 can be rigidly coupled with the outer concentric camshaft 18 in a way that prevents rotational or radial displacement between the rotor 22 and the camshaft 18. The housing 24 can be generally cylindrically-shaped and have a camshaft sprocket 30, and a plurality of fluid chambers 32 for receiving the vanes 28. The camshaft sprocket 30 includes a plurality of radially-outwardly extending sprocket teeth that extend in an uninterrupted row along a radial surface of the housing 24. The camshaft sprocket 30 engages an endless loop (not shown), such as a chain, which also engages a crankshaft sprocket (not shown) and translates the rotational force created by the crankshaft into rotational motion of the housing 24. As the crankshaft rotates during engine operation, the housing 24 correspondingly rotates as well.

The dependent camshaft phaser 14 includes a camshaft plate 36, shaped slots 38, pins 40, pivotable arms 42, a half-Oldham link 44, and secondary pivotable arms 46. The dependent camshaft phaser 14 receives angular movement from the independent camshaft phaser 12 as the phaser 12 moves the rotor 22 relative to the housing 24 and changes the angular position of the outer concentric camshaft 18 relative to the crankshaft. As the outer concentric camshaft 18 is angularly displaced relative to the crankshaft, the inner concentric camshaft 20 is angularly displaced relative to the outer concentric camshaft 18 and/or the crankshaft. The pivotable arms 42 and the half-Oldham link 44 can collectively form an Oldham coupling that permits radial displacement of the outer concentric camshaft 18 relative to the inner concentric camshaft 20. The Oldham coupling can help prevent binding of one camshaft relative to another if radial loads angularly deflect one camshaft relative to another. Binding of one camshaft relative to another may prevent the VCT system 10 from smoothly changing the angular position of one camshaft relative to another. The camshaft plate 36 can rigidly couple with the outer concentric camshaft 18 such that the plate 36 is not angularly displaced relative to the camshaft 18. The camshaft plate 36 can include radially-outwardly extending flanges 48 within which the shaped slots 38 can be formed. The shaped slots 38 can extend from one radial face of the flange 48 and have a width that accommodates pins 40 that slide relative to the slots 38. The width can be dimensioned so that the pins 40 can move radially within the slot in response to the radial movement permitted by the Oldham coupling. The pins can be implemented in different ways. For example, the pins shown in FIG. 4 include a stud surrounded by a bushing. The stud could be made of a metal alloy while the bushing may be implemented as an elastomeric donut. However, pins could also be implemented as a stud without a bushing. So the term "pins" should be broadly viewed as encompassing both implementations as well as others. The shape of the shaped slots 38 can be defined according to the desired angular movement desired of the inner concentric camshaft 20 relative to the outer concentric camshaft 18 as the rotor 22 of the independent camshaft phaser 14 rotates. For instance, the rate of angular movement of one camshaft relative to another can be controlled via the shape of the shaped slots 38. In this implementation, two slots and two pins are used but it should be appreciated that greater or fewer quantities of slots and pins can be used.

The pins 40 can be rigidly coupled to a radial face of the pivotable arms 42 and extend axially parallel to the axis of camshaft rotation to engage the shaped slots 38. As the camshaft plate 36 rotates in response to the angular movement of the rotor 22, the torque generated by the rotation can be transmitted from the plate 36 to the pins 40 through the shaped slots 36. The pivotable arms 42 can be arcuately shaped to have a base pivot 50 at one end of the arms 42 and a linking pivot 52 at another end. The pivotable arms 42 can be formed using a pair of arcuate plates that are sistered on opposite sides of the flanges 48 with the pins 40 positioned in between the plates. The linking pivot 52 can be pivotably connected to the secondary pivotable arms 46 at one end. Another end of the secondary pivotable arms 46 can be pivotable connected to the half-Oldham link 44. In that way, the secondary pivotable arms 46 can include two pivots: one pivot coupled to the pivotable arms 42 and another pivot coupled to the half-Oldham link 44.

The half-Oldham link 44 can include an arcuate outer surface 54 that is shaped to fit concentrically and in close conformity to an inner surface 56 of the camshaft plate 36. The diameter of the outer surface 54 can be slightly smaller than the inner surface of the camshaft plate 36 creating a spatial clearance 62 to permit small amounts of radial movement of the half-Oldham link 44 relative to the camshaft plate 36 as part of movement permitted by the Oldham coupling. The half-Oldham link 44 can include a key slot 58, concentric to the outer surface 54, shaped to receive a key 60 that is rigidly coupled to the inner concentric camshaft 20. The key 60 can be rectangularly shaped such that it has a rectangular cross-section. The key slot 58 can be shaped to receive the key 60 and permit the half-Oldham link 44 move radially with respect to the key 60 and the inner concentric camshaft 20 in one radial direction. The inner concentric camshaft 20 can move in another, different radial direction relative to the camshaft plate 36 and the outer concentric camshaft 18. The secondary pivotable arms 46 can permit such movement in conjunction with the spatial clearance between the outer surface 54 of the half-Oldham link 44 and the inner surface of the camshaft plate 36. The base pivot 50 and the linking pivot 52 can permit the half-Oldham link 44 to move in a radial direction other than the movement permitted by the key slot 58 and key 60 thereby collectively implementing an Oldham coupling while also communicating angular movement from the rotor 22 to the inner concentric camshaft 20 through the camshaft plate 36, the shaped slots 38, the pins 40, the pivotable arms 42, the half-Oldham link 44, and the key 60.

Figure 5:
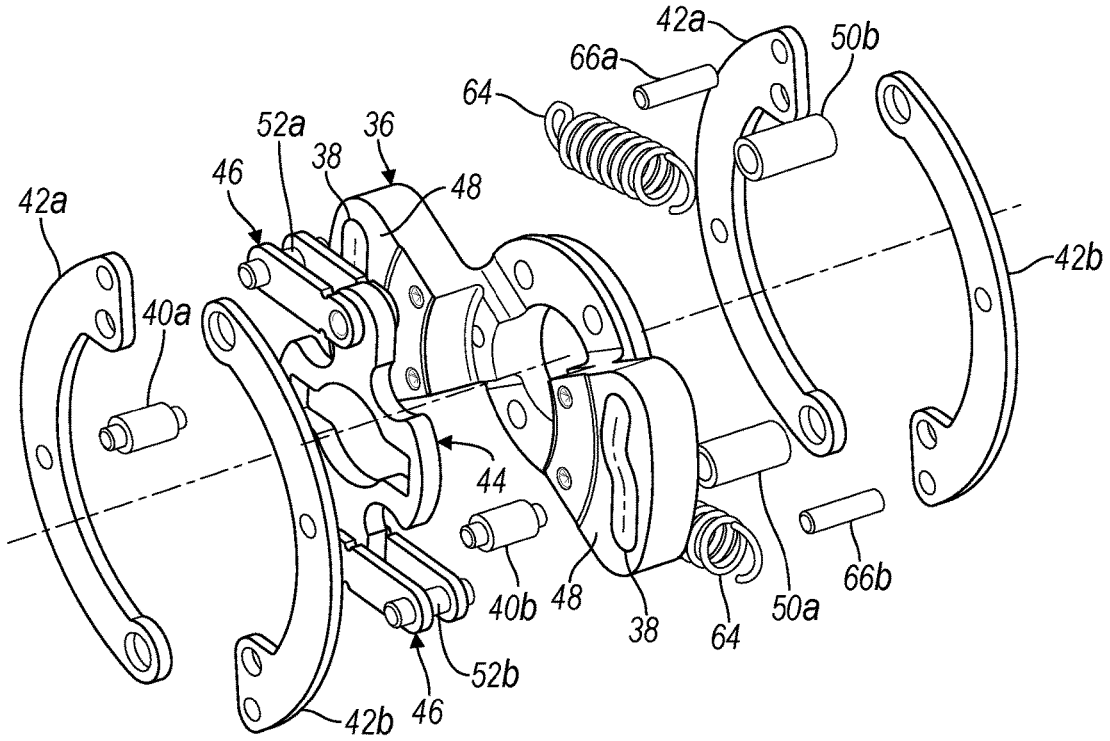
FIG. 5 is an exploded view depicting a portion of an implementation of a VCT system.
Figure 6:
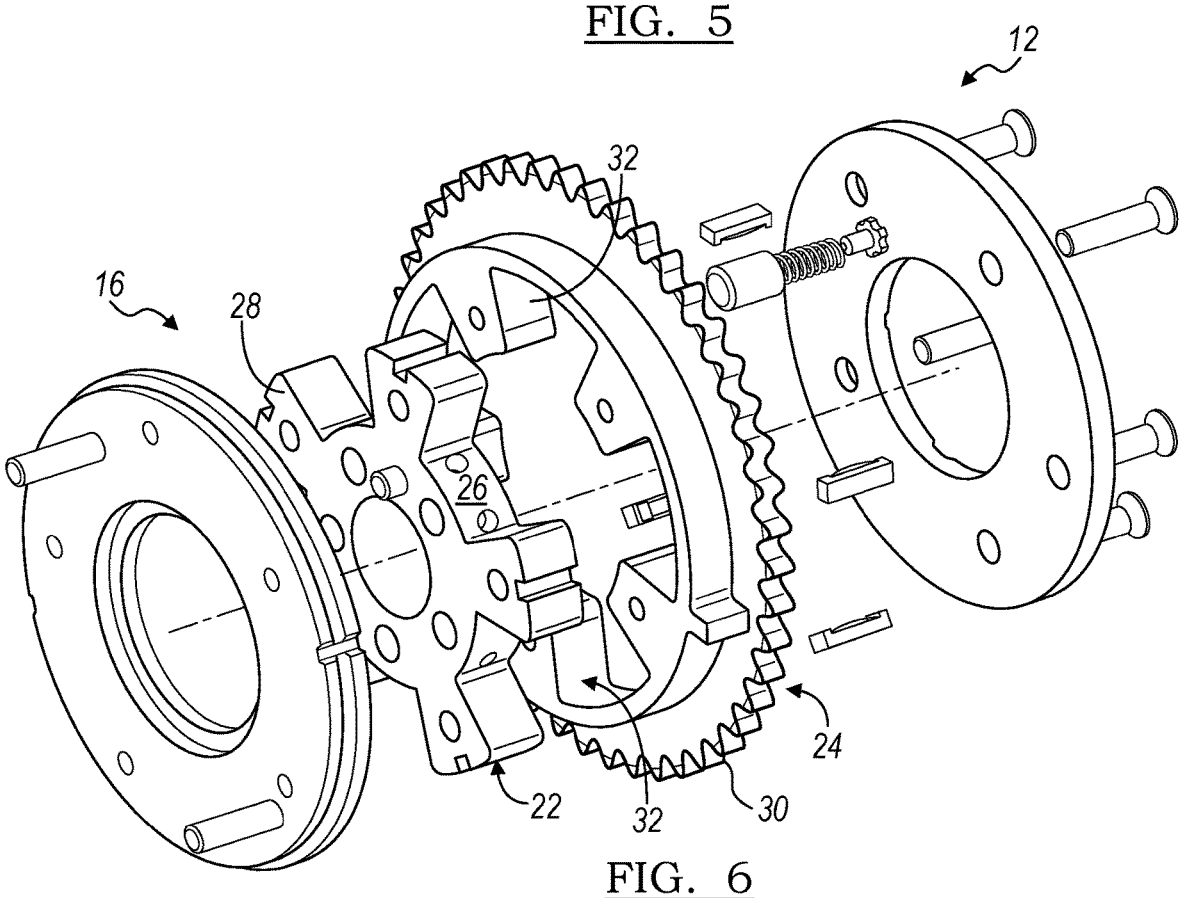
FIG. 6 is an exploded view depicting a portion of an implementation of a VCT system.

Dependent bias springs 64 can link a first pivotable arm 42*a* and pin 40*a* to a second pivotable arm 42*b* and pin 40*b*, shown in FIG. 5. The first pivotable arm 42*a* can include a mounting point 66*a*, adjacent the linking pivot 52*a*, and a base pivot 50*a*. A dependent bias spring 64 can couple with the mounting point 66*a* and the base pivot 50*b* to bias these two elements together. Similarly, the second pivotable arm 42*b* can include a mounting point 66*b*, adjacent the linking pivot 52*b*, and a base pivot 50*b*. A dependent bias spring 64 can couple with the mounting point 66*b* and the base pivot 52*a* to bias these two elements together. The effort exerted by the dependent bias springs 64 can reduce the effort needed to move the inner concentric camshaft 20 in an advancing direction thereby increasing the rate at which phasing can occur.

The VCT system 10 can include a sensor wheel 68 that concentrically receives the independent camshaft phaser 12, the dependent camshaft phaser 14, and at least a portion of the sprocket 30. One or more independent bias springs 70 can be positioned axially in between the sensor wheel and the sprocket in a way that engages both the sensor wheel and the sprocket to assist phasing of the outer concentric camshaft 18.

Figure 7:
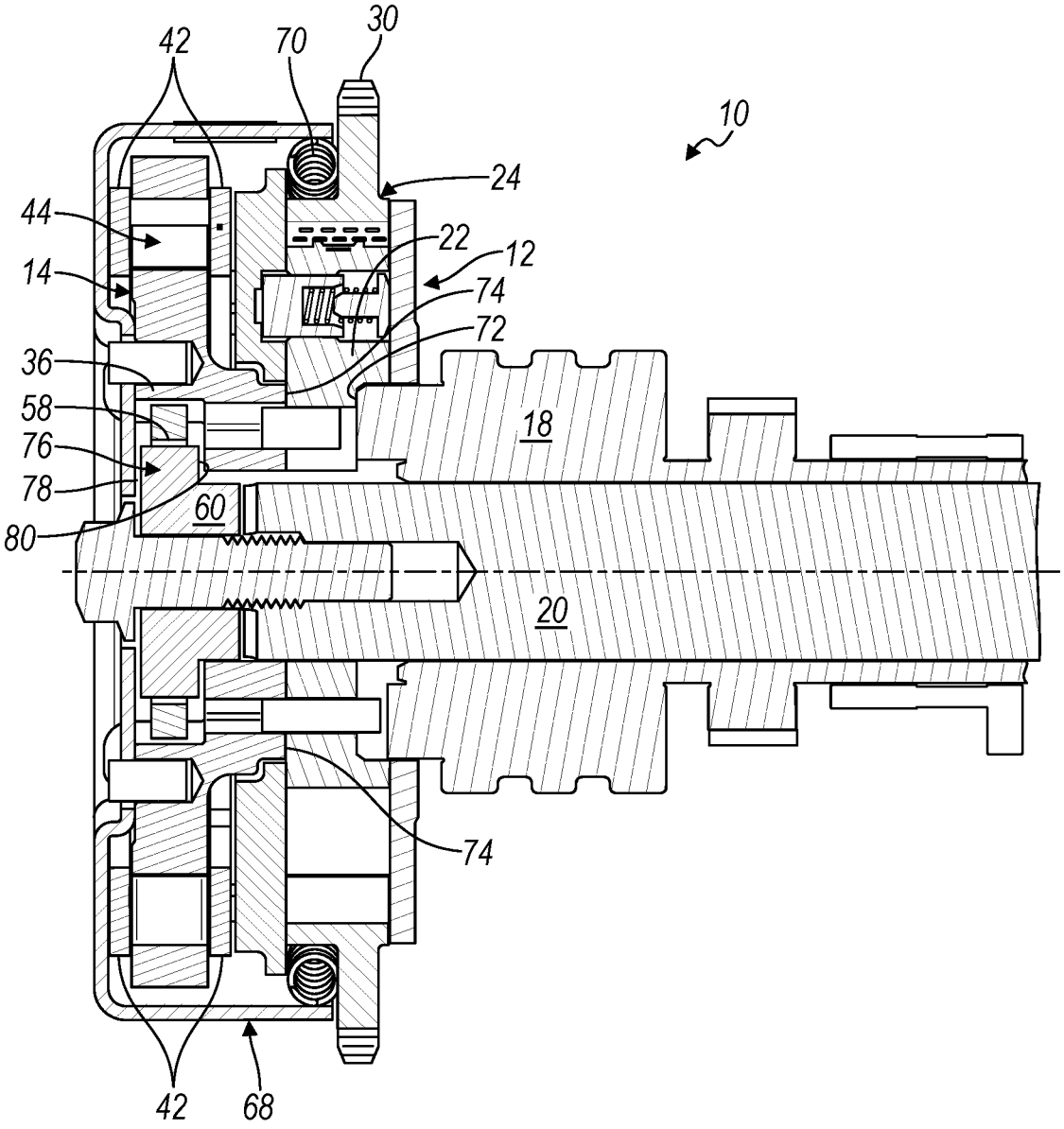
FIG. 7 is a cross-sectional view depicting an implementation of a VCT system.

The VCT system 10 can also control axial displacement of the outer concentric camshaft 18 relative to the inner concentric camshaft 20. Uncoupled from the VCT system 10, the outer concentric camshaft 18 and the inner concentric camshaft 20 can move axially relative to each other a small amount within a defined tolerance. Once coupled with the VCT system 10, the outer concentric camshaft 18 and the inner concentric camshaft 20 can abut components of the system 10 to define an axial relationship between the outer concentric camshaft 18 and the inner concentric camshaft 20. For instance, the outer camshaft 18 can abut a radial surface 72 of the rotor 22 as is shown in FIG. 7. The camshaft plate 36 can abut an opposite radial surface 74 of the rotor 22. The key 60 can rigidly connect to the inner concentric camshaft 20 via a bolt. A portion 76 of the key 60 can be axially constrained between the camshaft plate 36 and, in this implementation, the sensor wheel 68, thereby controlling the relative axial movement between the outer concentric camshaft 18 and the inner concentric camshaft 20. The distance between a radial surface 78 of the sensor wheel 68 and a radial surface 80 of the camshaft plate 36 can be defined to be greater than the axial length of the portion 76 of the key 60 to control an amount of axial movement permitted between the camshafts 18, 20.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A variable camshaft timing (VCT) system, comprising:

an independent camshaft phaser, configured to receive input from a crankshaft of an internal combustion engine, having an output configured to be coupled to an inner concentric camshaft or an outer concentric camshaft; and a dependent camshaft phaser comprising:

a camshaft plate coupled to the output;

a plurality of pivotable arms that engage the camshaft plate through one or more pins;

a plurality of secondary pivotable arms that pivotably connect to a distal end of the pivotable arms; and a half-Oldham plate pivotably coupled to the secondary pivotable arms, wherein the half-Oldham plate permits radial movement of the inner concentric camshaft relative to the outer concentric camshaft in one radial direction, the pivotable arms and the secondary pivotable arms permit radial movement of the inner concentric camshaft relative to the outer concentric camshaft in another, different radial direction.

2. The VCT system recited in claim 1, further comprising a key slot configured to engage a key and permit radial movement of the key relative to the key slot.

3. The VCT system recited in claim 1, wherein the independent camshaft phaser limits axial movement of the inner concentric camshaft relative to the outer concentric camshaft.

4. The VCT system recited in claim 1, wherein the dependent camshaft phaser limits axial movement of the inner concentric camshaft relative to the outer concentric camshaft.

5. The VCT system recited in claim 1, further comprising the camshaft plate comprising one or more shaped slots shaped to receive the pin(s) carried by the pivotable arms and transmit angular movement from the independent camshaft phaser to the dependent camshaft phaser.

6. A variable camshaft timing (VCT) system, comprising:

an independent camshaft phaser, receiving input from a crankshaft of an internal combustion engine, having an output coupled to an outer concentric camshaft; and a dependent camshaft phaser comprising:

a camshaft plate coupled to the outer concentric camshaft;

a plurality of pivotable arms that engage the camshaft plate through one or more pins;

a plurality of secondary pivotable arms that pivotably connect to the plurality of pivotable arms;

a half-Oldham plate, pivotably coupled to a distal end of the secondary pivotable arms, having a key slot; and a key, rigidly coupled to an inner concentric camshaft, that is received by the key slot, wherein the key moves relative to the key slot to permit radial movement of the inner concentric camshaft relative to the outer concentric camshaft in one radial direction, the pivotable arms and the secondary pivotable arms permit radial movement of the inner concentric camshaft relative to the outer concentric camshaft in another, different radial direction.

7. The VCT system recited in claim 6, wherein the independent camshaft phaser limits axial movement of the inner concentric camshaft relative to the outer concentric camshaft.

8. The VCT system recited in claim 6, wherein the dependent camshaft phaser limits axial movement of the inner concentric camshaft relative to the outer concentric camshaft.

9. The VCT system recited in claim 6, wherein the camshaft plate includes one or more shaped slots shaped to receive the pin(s) carried by the plurality of pivotable arms and transmit angular movement from the independent camshaft phaser to the dependent camshaft phaser.

10. The VCT system recited in claim 6, further comprising one or more dependent bias springs coupled to the plurality of pivotable arms.

11. The VCT system recited in claim 6, further comprising one or more independent bias springs.

* * * * *